United States Patent [19]

Näslund

[11] 4,347,726

[45] Sep. 7, 1982

[54] METHOD AND DEVICE FOR BENDING SHEET-METAL SECTIONS

[75] Inventor: Gustav Näslund, Älvsbyn, Sweden

[73] Assignee: Groko Maskin AB, Luleå, Sweden

[21] Appl. No.: 198,943

[22] PCT Filed: Nov. 6, 1979

[86] PCT No.: PCT/SE79/00227

§ 371 Date: Jul. 3, 1980

§ 102(e) Date: Jul. 3, 1980

[87] PCT Pub. No.: WO80/00932

PCT Pub. Date: May 15, 1980

[30] Foreign Application Priority Data

Nov. 8, 1978 [SE] Sweden ..... 7811538

[51] Int. Cl.[3] ..... B21D 37/10

[52] U.S. Cl. ..... 72/385; 72/389; 72/412

[58] Field of Search ..... 72/385, 379, 307, 412, 72/470, 414, 384, 389, 380

[56] References Cited

U.S. PATENT DOCUMENTS

| | | | |
|---|---|---|---|
| 1,434,068 | 10/1922 | Schlafly | 72/379 |
| 1,880,479 | 10/1932 | Ragsdale | 72/412 |
| 2,199,377 | 4/1940 | Tangerman | 72/379 |
| 3,499,308 | 3/1970 | Ford | 72/379 |
| 3,874,214 | 4/1975 | Racicot | 72/307 |
| 4,081,987 | 4/1978 | Hall | 72/470 |
| 4,138,875 | 2/1979 | Hooper | 72/307 |

*Primary Examiner*—Gene Crosby

*Attorney, Agent, or Firm*—Kenyon & Kenyon

[57] ABSTRACT

The invention relates to a method and a device for bending sheet-metal sections. It is previously known to bend sectional sheets, but the known art involves certain problems to bring about a non-angular bend with a small radius and without damaging the sheet. According to the invention it is proposed for eliminating said problems, that in connection with the impressing of the sheet portions located closest to the bending axis the lateral portions (1*c*; 32*c*; 50*c*) of the sheet are subjected to an outwardly directed force (17; 39; 56) or prestressing in a plane through the impressions (34; 59), in order to form an outward bulging (40; 58) in the lateral portions (1*c*; 32*c*; 50*c*) and on the same side of the sheet as the impressions (34, 59).

9 Claims, 13 Drawing Figures

METHOD AND DEVICE FOR BENDING SHEET-METAL SECTIONS

Figure 1:
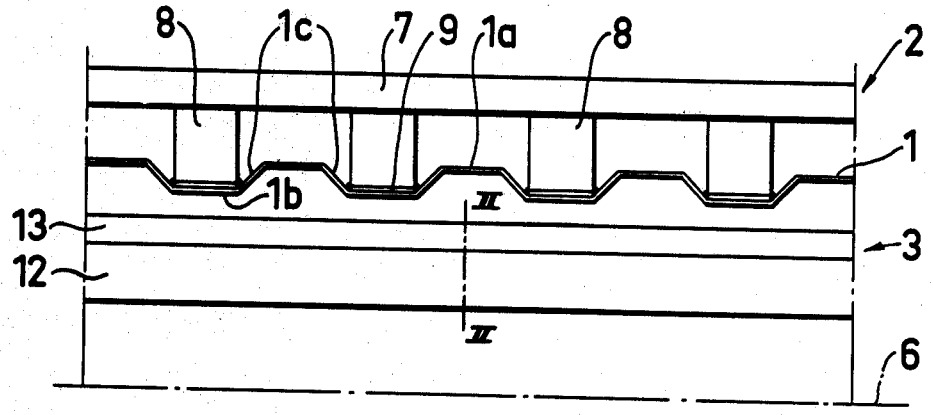

This invention relates to a method of bending a sheet-metal section, which includes alternating longitudinal ridges and troughs, and the lateral portions of which also are the lateral portions of the ridges, about an axis, which extends perpendicularly to the longitudinal direction of the ridges and troughs and is in parallel with the plane of the sheet. The invention also relates to a device for carrying out the method.

It is previously known at the bending of such sectional or corrugated sheet about an axis extending perpendicularly to the corrugations and in parallel with the plane of the sheet to form in the corrugations, which with their tops are located closest to said axis, strip-shaped protrusions in the direction of the axis which project from one and the same side of the sheet, in such a manner, that each such protrusion extends at least partially over the sides of a corrugation and the intermediate portion uniting the sides, and the protrusions are given such a shape that the sheet shrinks more closely to the axis than farther away therefrom. By this way of bending a sectional sheet an accumulation of material is obtained in the transistion area between the side and the intermediate portion of a corrugation, which accumulation renders it impossible to bend a sectional sheet provided with a surface-covering coat without damaging the coat in one way of the other. It is not possible, either, by said known bending method to bring about a bend with a radius below 750 mm, which reduces substantially the applicability of this bending method.

It is further known to bend a sheet-metal section about an axis, which extends perpendicularly to the longitudinal direction of the corrugation and in parallel with the plane of the sheet, by a method, according to which impressions are made in radial direction from the axis only in those portions of the corrugations of the sheet which face toward the said axis. Said impressions are made in consecutive steps until the desired bending angle has been obtained. By this known method it is possible, contrary to said firstmentioned bending method, to bend also a sectional sheet, which is provided on one and/or the other side with a surface-covering coat, without damaging the coat on either side, provided that the sheet at the moment when the impressions are being made is not clamped on either side of the place of impression, but can move freely relative thereto. Even when the sheet is clamped only on one side of the place of impression, the lastmentioned method of bending a sheet-metal section involves a certain risk, that the sheet in certain parts is subjected to stretching, whereby a possible surface coat will be damaged and also the bending result will be deteriorated, i.e. the bending or deflection line will be more or less discontinuous.

The present invention, therefore, has the object to overcome the disadvantages involed with the lastmentioned method of bending sheet-metal sections, especially when it concerns the bending of clamped sheet metal, and at the same time to bring about a method and a device, which render it possible to bend sectional sheets with a radius, which is substantially smaller than heretofore possible, without damaging the sheet even when it is surace-coated. This object is achieved in that the method and the device according to the present invention have been given the characterizing features defined in the attached claims.

Figure 2:
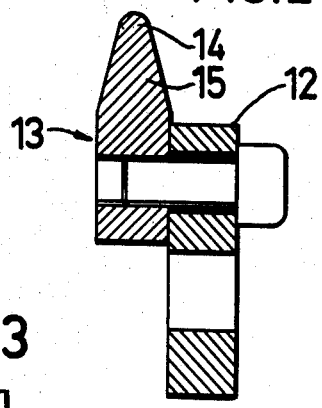
Figure 3:
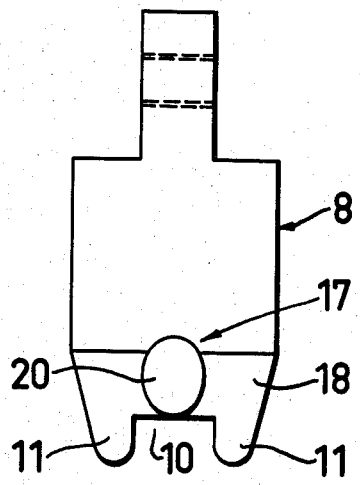
Figure 4:
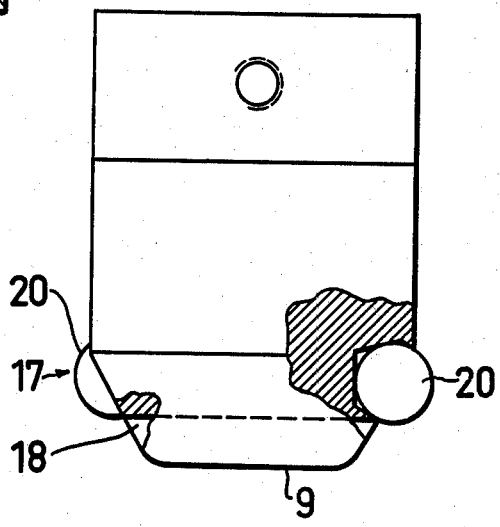
Figure 5:
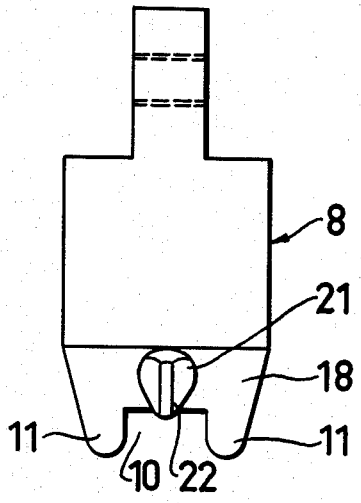
Figure 6:
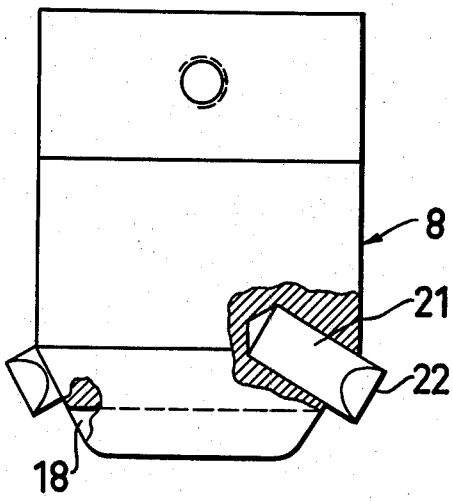

The invention is described in greater detail in the following, with reference to the accompanying drawings, in which FIG. 1 is a section of a bending tool for bending a trapezoid sectional metal sheet according to the invention, shown in a schematic way, FIG. 2 is a section along the line II—II in FIG. 1 through the lower portion of the bending tool formed as a pressing bar, FIG. 3 is an end view of a bending die comprised in the upper portion of the bending tool and acting as a dolly member, FIG. 4 is a lateral view of the bending die shown in FIG. 3, FIGS. 5 and 6 are an end view and, respectively, a lateral view of an alternative embodiment of the bending die shown in FIGS. 3 and 4, FIGS. 7 and 8 are an end view and, respectively, a lateral view of a futher embodiment of the bending die according to the invention.

Figure 11:
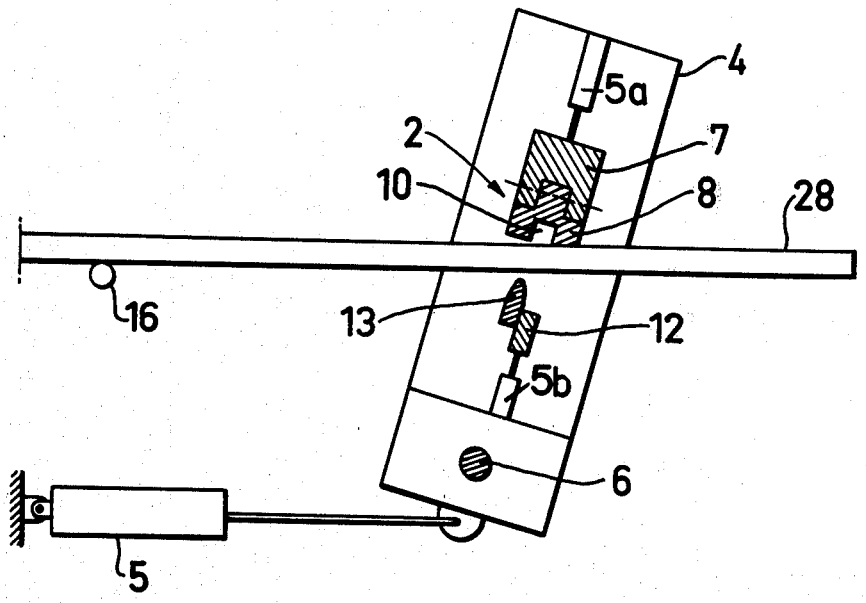
Figure 7:
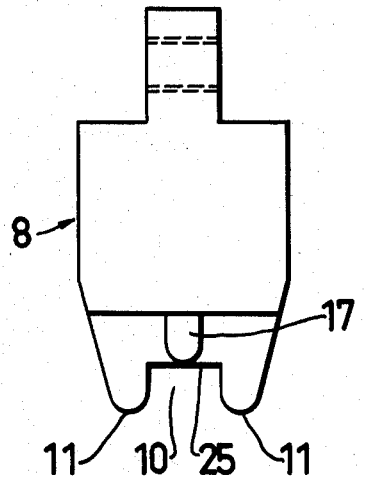
Figure 8:
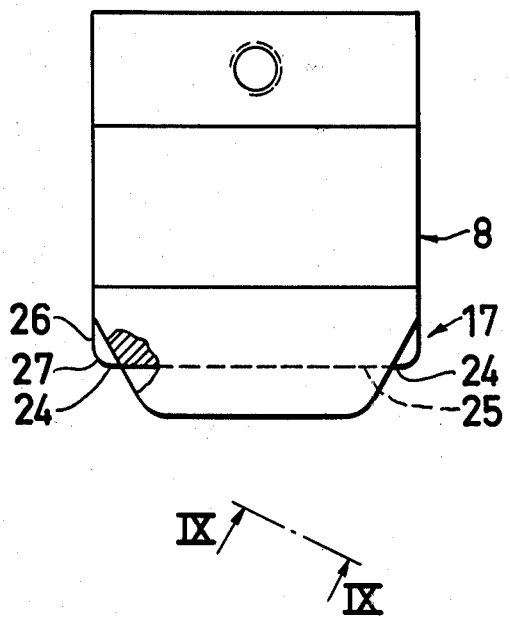
Figure 9:
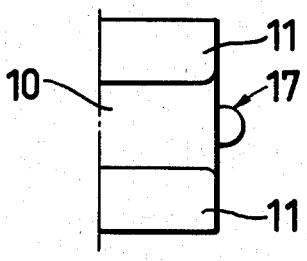
Figure 10:
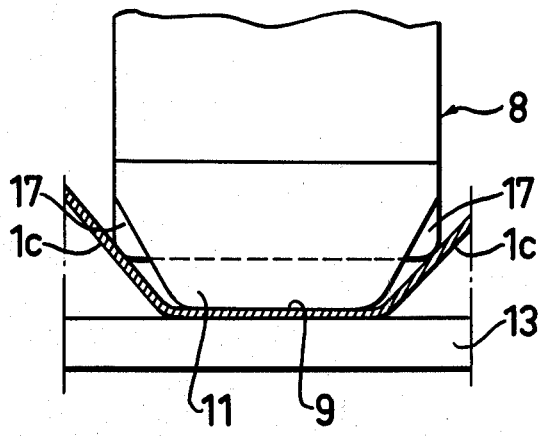
Figure 12:
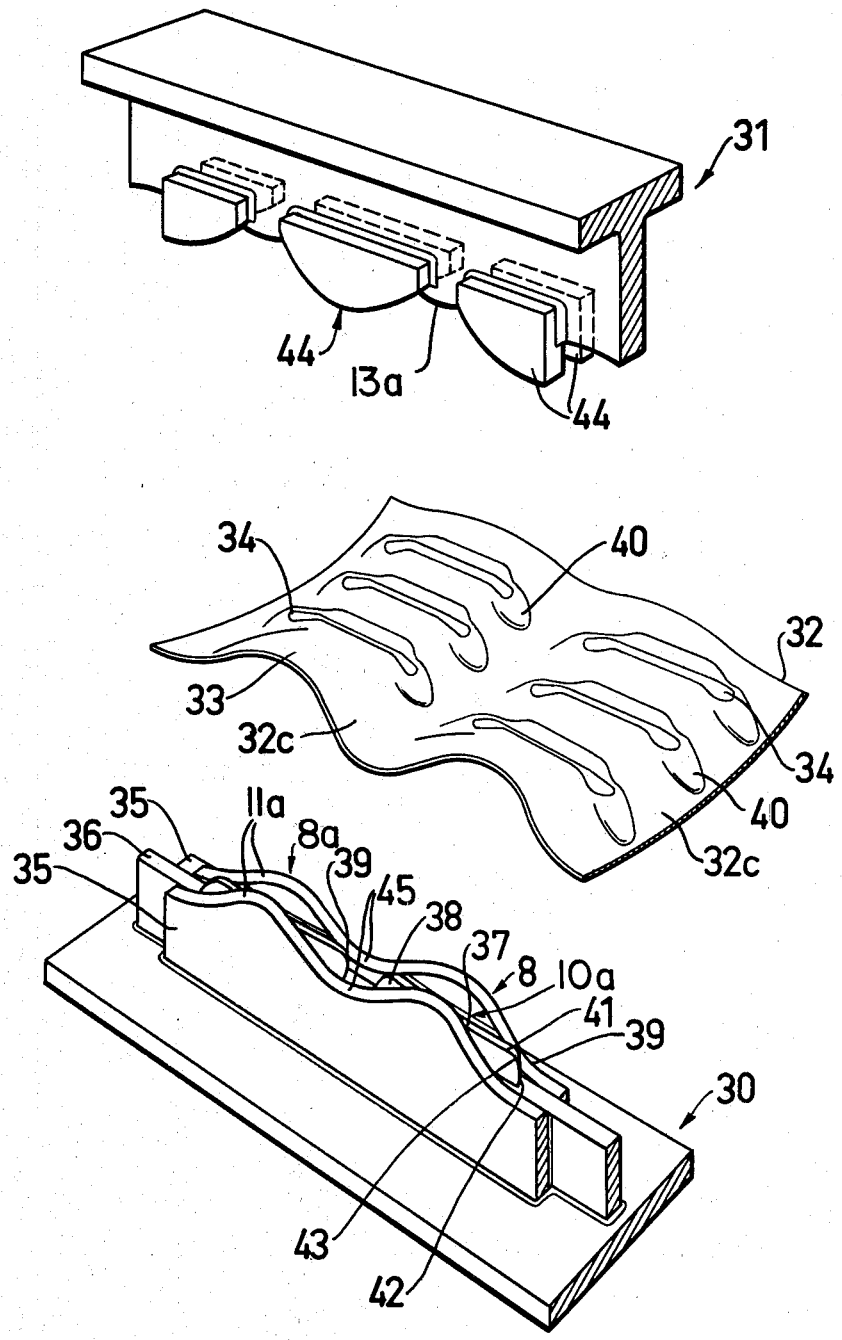
Figure 13:
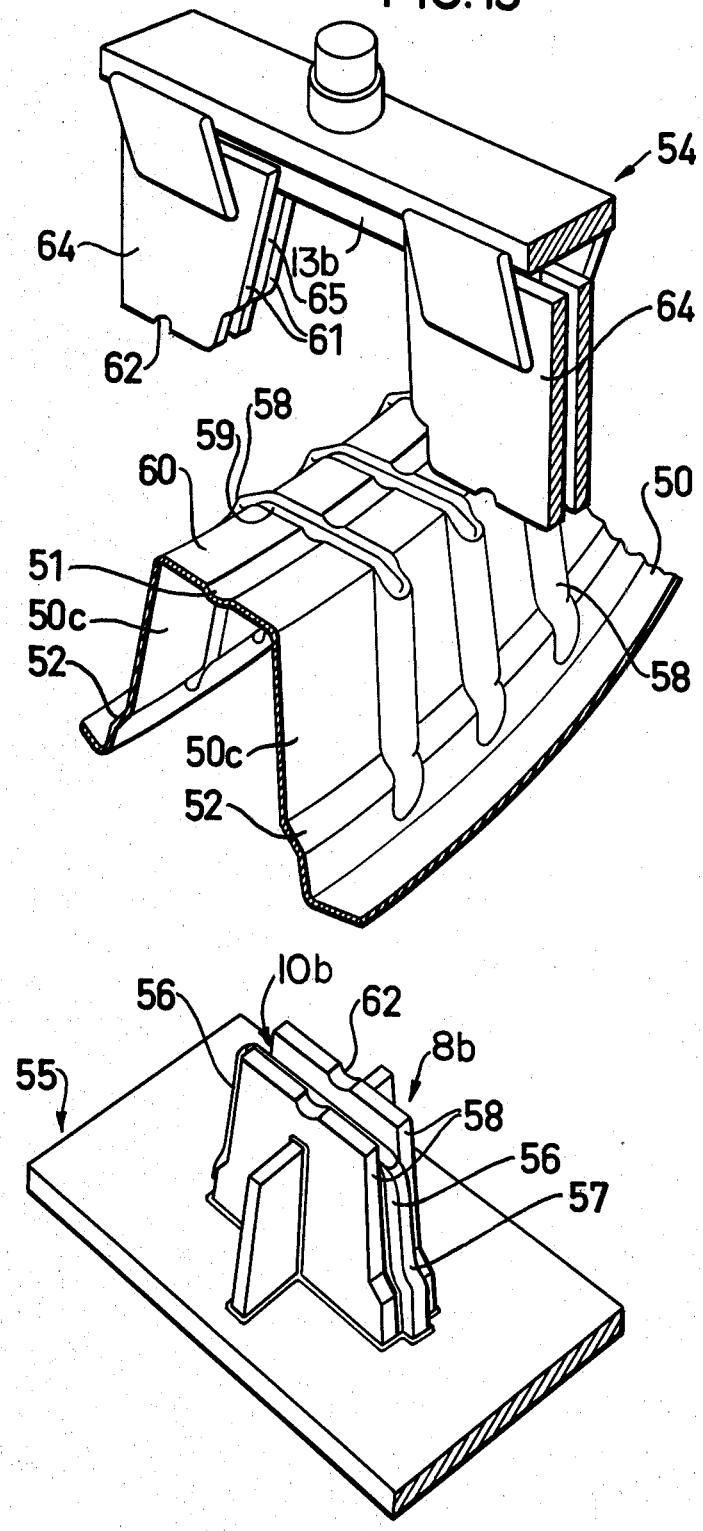

FIG. 9 is a view seen substantially along the line IX—IX in FIG. 8,

FIG. 10 is a view for illustrating the applying of a bending die, more precisely the bending die shown in FIGS. 7–9, against a sheet, FIG. 11 is a section through a bending frame supporting the bending tool, shown in a schematic way, FIG. 12 is a perspective and schematic view of a bending tool according to the invention for bending a sinusoidal sectional sheet, the upper and the lower portion of the tool being shown separated by a sheet being bent, which sheet is provided with only two ridges and located between said portions, and FIG. 13 is a perspective and schematic view of a bending tool according to the invention for bending a substantially U-shaped metal sheet section with great section height and reinforced lateral portions, the upper and the lower portion of the tool being shown separated and a U-shaped section being bent located therebetween.

In FIG. 1 the numeral 1 designates a trapezoid sectional metal sheet, which is shown disposed for being bent between the upper and the lower portion 2 and, respectively, 3 of a bending tool. The portions 2 and 3 are individually movable toward and from one another and arranged in a bending frame 4, which may be comprised in a bending machine, which includes two such bending frames movable relative to each other for bending a sectional metal sheet simultaneously about two parallel axes, which extend perpendicularly to the longitudinal direction of the profile, i.e. of the ridges 1*a* and the troughs 1*b*, and are in parallel with the plane of the sheet. Each such bending frame 4, as schematically shown in FIG. 11, is pivotal about a shaft 6 mounted in the stand of the bending machine (not shown) by electrically, pneumatically or hydraulically controlled drive means 5, for example a piston-cylinder means. Such drive means 5*a* and 5*b* may also be used to drive the bending machine parts 2 and 3. Said shaft 6, thus, supports the bending frame 4 and is in parallel with the axis, about which the sheet is to be bent.

The upper portion 2 of the bending tool comprises a number of bending dies 8 mounted in a holder 7 and corresponding at least to the number of troughs 1 in a sheet. The dies project from the holder 7 through a distance corresponding at least to the height of the sheet section and have at their lower portion a shape corresponding substantially to the respective cross-sectional shape, in such a manner, that in the case of a trapezoid sheet section the die end 9 facing to the sheet shall have a width, which must not be greater than the smallest width of the trough bottom between the lateral portions 1*c*, as is apparent especially from FIG. 10. Every die is provided in the cross-section with a groove 10, which extends across the entire width of the die and has a depth corresponding to the intended impression depth in the sheet. The portions 11 enclosing the groove 10 and each formed with a rounded end profile are intended to support the sheet at the moment of bending, as will become more evident from the following.

The lower portion 3 of the bending tool is intended to cooperate with the upper bending dies and comprises a pressing bar 13, which is supported by a holder 12 and has a pressing portion 15 tapering to a rounded end profile 14. The pressing portion is intended to be pressed into the grooves 10 of the dies and thereby into the lower surface of the sheet lying therebetween, which surface consists of the trough bottoms, and to form impressions extending across the entire width of the trough bottoms and being corresponded by protrusions on the other side of the trough bottoms. For each such effected impression across the entire width of the sheet, the sheet is bent through a definite predetermined angle. By effecting several such impressions consecutively in rows and in spaced relationship, either by moving the sheet 1 in steps relative to the bending tool or by moving said tool relative to the sheet, the sheet can be bent through at least 180° and even to a radius as small as 30 mm, depending on the section height and impression depth.

In order to eliminate stretchings in the sheet at each such impressing, even when the sheet is rigidly clamped on one side of the bending tool, for example at the sheet support 16 in FIG. 11, according to the present invention the lateral portions 1*c* of each trough are subjected to an outwardly directed pressure, prior to or simultaneously with the effecting of an impression. This pressure is brought about, at the embodiments shown in FIGS. 1–11, by means of protrusions 17 projecting from each die 8, which protrusions at the lowering of the upper tool portion 2 are caused to contact the lateral portions 1*c* of a trough (FIG. 10), so that they press the lateral portions 1*c* of the trough in the direction away from each other by a definite predetermined force, at the latest when each die 8 with its support member 11 abuts the sheet and acts as a support therefor. When the pressing bar 13 is pressed in against the sheet portions located between the support members 11 of the dies in order to effect said impressions, the lateral portions 1*c* are caused by said laterally directed forces to bulge outward in the area about the ends of the protrusion formed in the upper surface of the trough bottom by the impression and hereby are given a permanent, softly outwardly bulging "natural deformation" in said area of the lateral portions 1*c*, which receives the surplus material formed at every impressing, without giving rise to sharp folds or stretchings, which may cause crack formation or other damages in a possible surface coat on the sheet.

At the embodiment shown in FIGS. 3 and 4, the pressure exerting protrusions 17 of the dies have the form of balls 20 rotatably mounted in the sides 18 of the dies extending to the end 9, and at the embodiment shown in FIGS. 5 and 6 the said protrusions have the form of pins 21 fastened in said sides 18 of the dies and having an end surface 22, which is substantially in parallel with the lateral portions 1*c* of the trough for bringing about a pressure substantially perpendicular to said portions. The protrusions 17, irrespective of whether they are in the form of balls or pins, shall be located centrically in relation to the groove, and their lower point be on the same level as or slightly above the level of the goove 10. The balls 20 as well as the pins 21 preferably are made of plastic or another easily sliding material, preferably with self-lubricating properties, which especially applies to the pins, because the balls by their rotatability roll against the lateral portions of the troughs when the die is being applied, so that the balls do not give rise to scratches or the like in a possible surface coat, even if the coat consists of a steel material. The protrusions 17 of the dies also may have the form of a rotatably mounted cylinder, though this is not shown in the drawings.

At the embodiment of the die according to the invention shown in FIGS. 7–9 the protrusions 17 are designed integral with the die 8. Also at this embodiment each such protrusion 17 is located symmetically in relation to the groove 10 of the die, and its downwardly directed end surface 24, as shown in FIG. 7, is rounded and lies in the same plane as and substantially in parallel with the bottom surface 25 of the groove. Said end surface 24 then transforms into a rounded lateral surface 26 and forms a rounded corner 27. The corners 27 of these protrusions constitute the pressing part of the bending die in order to effect the said laterally directed forces against the lateral portions 1*c* of the trough when the die is applied to the sheet, and thereby for obtaining at least an outwardly directed prestressing of these lateral portions 1*c* before the impression proper of the trough bottom 1*b* is effected by means of the pressing bar 13 in cooperation with bending die 8.

At the bending machine shown schematically in FIG. 11, it is the bending tool located in the bending frame 4 which for each impression is moved in steps relative to the sheet 1 to be bent. Said movement at the embodiment shown takes place in the form of a stepped pivotal movement about the axle 6, starting from a substantially upright position, in which the frame 4, however, should have a certain inclination relative to the normal plane of the sheet, so that the sheet, i.e. the portion 28 thereof, is bent in the right direction, i.e. downward in FIG. 11, already at the first impression. The inclination of the frame in starting position may correspond to an angle being half the angle, through which the frame is pivoted at each bending step, and which is a multiple of the final bending angle.

As already mentioned, the stepped rotation of the frame 4 about the axle 6 is effected by the drive means 5. Said drive means 5, which in FIG. 11 is shown in the form of a hydraulically or pneumatically operated piston-cylinder means, according to the invention is controlled so in dependency on the lower portion of the bending tool, that it is either entirely disengaged when the pressing bar 13 of the bending tool contacts the sheet 1, so that the frame 4 during the impression moment proper is freely movable relative to the axle 6 and can be caused to carry out a short return movement, or said drive means forcibly effects the return or spring-back movement of the bending frame relative to the sheet 1. This return or spring-back movement very efficiently contributes to prevent the material in the sheet from being stretched in a damaging way.

FIG. 12 shows an embodiment of the bending tool according to the invention which is intended to bend sinusoidal sectional sheet metal. The tool comprises a lower portion 30, which at the embodiment shown is intended to be stationarily mounted, for example on a pressing table (not shown) of a press known per se, and an upper portion 31, which shall be connected to the movable part of the press for being moved toward and from the lower portion 30 of the tool and thereby in cooperation with said lower portion to bend a sheet 32 inserted between the tool portions 30, 31 about an axis, which extends perpendicularly to the profile of the sheet and in FIG. 12 lies above the sheet 32, by effecting consecutive parallel impressions 34 in the portions 33 of the sheet which are located closest to said portion. Hereby the sheet is advanced in steps, instead of the tool as described above, but the tool according to FIG. 12 and also according to FIG. 13 can be used in a bending frame 4 pivotal in steps. It should further be mentioned that the lower and the upper portion of the tool shown in FIG. 12 can change place, so to say, so that the lower portion acts as upper portion and the upper portion acts as lower portion, in which case, however, the bending will take place about an axis lying beneath the sheet, as at the embodiment according to FIGS. 1 and 11. This possibility of place interchange between the upper and the lower portion of the tool applies generally to the tool according to the invention and, thus, applies to the embodiment according to FIGS. 1–11 as well as to FIG. 13.

At the embodiment shown in FIG. 12, distinguishing from the embodiment shown in FIGS. 1–11 of the drawings, the pressing bar 13*a* is located in the upper portion 31 of the tool and the dies 8*a* are located in the lower portion 30 of the tool. The dies are shown coherent in the form of a single integral part, with an outline corresponding to the cross-sectional shape of the sheet, and are formed of two plates 35, which have said outline and between which a spacer 36 is located to form the groove 10*a* of the dies between the support members 11, into which groove the pressing bar 13*a* is intended to press the sheet portions located between the support members 11*a* and thereby to form the impressions 34. The depth of the groove is determined by a surface 37 of a boss 38 provided on the spacer 36 between the support members 11*a* of each die. The end portions of the boss lying outside the outline of the support members form protrusions 39, which like the protrusions 17 at the embodiment according to FIGS. 7–9 are intended upon application of the upper portion 31 of the tool against the sheet 32 supported by the lower portion 30 of the tool to exert the pressure forces directed to the lateral portions 32*c* of the corrugations in order to form in the lateral portions 32*c* of the corrugations outward bulgings 40 in the same plane as the impressions and at the ends thereof, in such a manner, that each impression 34 at its ends transforms to an outward bulging 40 and to some extent is extended therethrough.

Each protrusion 39 is located symmetrically in relation to the groove 10*a* of the die, and its end surface 41 constituting an extension of the bottom surface 37 of the groove is rounded convex and transforms to a convex rounded, inwardly inclined lateral surface 42 via a well-rounded corner 43.

The upper portion 31 at the embodiment according to FIG. 12 is provided with clamping members 44 located on both sides of the pressing bar 13*a* and directly in front of each other. The configuration of the clamping members corresponds to that of the corrugations, so that the clamping members upon application of the upper portion 31 against the lower portion 30 press the sheet against the surface 45 of the plates 35 located between the support members 11*a* and thereby act as dolly for the sheet on both sides of the protrusions 39. Said clamping members 44, like the plates 35, may be formed coherent and have an outline corresponding to the cross-sectional shape of the sheet.

The portions of the pressing bar 13*a* for effecting the impressions 34 may have convex arc-shape as indicated in FIG. 12, and the surface 37 constituting the bottom of the groove 10*a* has a corresponding concave arc-shape.

In FIG. 13 is shown in a schematic manner that it is possible, according to the basic principles on which the present invention is based, also to bend a sheet 50, which has trapezoid section and a great section height and is provided with both stiffening grooves 51 and reinforcing folds 52. For reasons of simplicity, only one corrugation is shown in FIG. 13. As in FIG. 12, the pressing bar 13*b* also in FIG. 13 is provided in the movable upper portion 54 of the tool and the dies 8*b* are provided in the stationary lower portion 55 of the tool, but also in this case it is possible to position the pressing bar 13*b* in the lower portion and the dies 8*b* in the upper portion of the tool.

At the embodiment according to FIG. 13, each die 8*b* has a configuration corresponding to the inner cross-sectional shape of the corrugations of the sheet, and protrusions 56 protruding on both sides, which protrusions distinguished from the protrusions 17 at previous embodiments extend along the entire height of the die from the bottom of the groove 10*b* in each die, and which with their convex rounded lateral surface 57 are in parallel with the closest side 58 of the die, except for its portion located closest to the groove 10*b* which is rounded to the bottom of the groove. The protrusions 56, thus, increase the width of the dies, so that a sheet 50 applied on the dies 8*b* in the lower portion 55 of the tool will rest with its lateral portions 50*c* againt the protrusions 56 and be supported by them at a distance above the supporting members of the dies located on both sides of the groove 10*b*. In order to prevent the lateral portions 50*c* of the sheet from springing out when the sheet is pressed down on the dies 8*b* of the lower portion, the upper portion of the tool is provided with counter-hold members 64 to support the lateral portions 50*c* of the sheet on the opposite side of each such portion, against which a protrusion 56 acts to form outward bulgings 58 in the lateral portions 50*c*, at the same time when the upper portion 54 of the tool is pressed down against the sheet applied on the lower portion 55 for effecting the impression 59 in those portions 60 of the sheet which are located closest to the axis, about which the sheet is to be bent. In order to render possible the formation of the outward bulgings 58, the counter-hold members are provided with grooves 65 located in the same plane as the pressing bar 13*a*. Each intermediate space between two counter-hold members 64, furthermore, is so formed that the support surfaces 61 of the counter-hold members which face toward each other and have a form corresponding to the form of the lateral portions, substantially completely abut the lateral portions of the sheet first when the pressing bar 13*b* located in each intermediate space between two counter-hold members 64 has been pressed-in through the intended distance and formed an impressions in the sheet which, thus, extends also over the outward bulgings wherat, however, certain folds are formed in the break between impressions and outward bulging.

The counter-hold members preferably can be given a configuration corresponding to the cross-sectional shape of the corrugations of the plate, in the intermediate portions 60 of which no impression takes place. For the stiffening grooves 51 of these intermediate portions, both each die 8*a* and each counter-hold member 64 are formed at their end with a depression 62.

The present invention is not restricted to what is described above and shown in the drawings, but can be altered and modified in many different ways within the scope of the invention idea defined in the attached claims.

I claim:

1. A method for bending a sheet-metal channel section having a bottom wall from one side of which lateral side walls extend, said method comprising suppoting a portion of said one side of the bottom wall only along interspaced mutually parallel lines of support extending transversely across the bottom wall for substantially its full width and holding the channel section against displacement from said lines only in a direction right angularly away from said one side and with said portion spanned by said lines free to move in at least one longitudinal direction of the channel, pressing only on the bottom wall's other side along a line extending substantially throughout the bottom wall's width and between said parallel lines and in addition pressing outwardly on localized portions of said side walls, which portions are in a plane normal to said one side and between said parallel lines of support, said pressings bending said portion of the bottom wall in the direction in which said lateral side walls extend and bending said portions of the side walls laterally outwardly, so as to cause the channel section to bend.

2. The method of claim 1 in which said pressings are started substantially at the same time and are continued together until said channel section bends.

3. The method of claim 2 in which said pressings are effected successively at a succession of positions which are mutually interspaced in the longitudinal direction of the channel section.

4. A device for bending a sheet-metal channel section having a bottom wall from one side of which lateral side walls extend, said device comprising an assembly formed by a straight pressing bar that is at least as long as said bottom wall is wide and opposite to said bar a bending die having a shape corresponding substantially to the cross-sectional shape of the channel section on its inside and a die end having a width no greater than the width of said one side, said die end having a channel adapted to receive said pressing bar, and actuating means for moving said pressing bar and bending die towards and away from each other between an open position to permit positioning of said channel section transversely therebetween and a closed position wherein said bending die transversely engages said channel section's bottom wall on its said one side and said pressing bar transversely engages said bottom wall on its other side and bends the bottom wall into the bending die's said channel to form an impression in said bottom wall which corresponds to the shape of said pressing bar, thereby causing bending of the channel section, said bending die having protrusions that extend transversely and press outwardly on localized portions of the channel section's said side walls as said pressing bar and bending die move to said closed position, said portions being aligned with said pressing bar so as to bend outward bulges in said side walls as said pressing bar and bending die close.

5. The device of claim 4 in which said protrusions are formed integrally with said bending die.

6. The device of claim 4 in which said protrusions are formed by elements separate from said bending die and connected thereto.

7. The device of claim 4 in which said protrusions are formed by rotative elements connected to said bending die.

8. The device of claim 4 in which said pressing bar has connected to it means for supporting the outsides of said localized portions of said side walls as they bend to form said outward bulges in the side walls.

9. The device of claims 4, 5, 6, 7, 8 in which said actuating means permits said pressing bar and bending die to move in the longitudinal direction of the channel section when moving to said closed position.

* * * * *